US006782953B2

(12) United States Patent
Maguire et al.

(10) Patent No.: US 6,782,953 B2
(45) **Date of Patent: *Aug. 31, 2004**

(54) TIE BACK AND METHOD FOR USE WITH EXPANDABLE TUBULARS

(75) Inventors: Patrick Maguire, Cypress, TX (US); Robert J. Coon, Missouri City, TX (US); J. Eric Lauritzen, Kingwood, TX (US); Mark Murray, Sugar Land, TX (US); Khai Tran, Pearland, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/382,321

(22) Filed: Mar. 5, 2003

(65) Prior Publication Data

US 2003/0141076 A1 Jul. 31, 2003

Related U.S. Application Data

(63) Continuation of application No. 09/885,500, filed on Jun. 20, 2001, now Pat. No. 6,550,539.

(51) Int. Cl.[7] ..... E21B 19/16; E21B 43/10

(52) U.S. Cl. ..... 166/380; 166/206; 166/207

(58) Field of Search ..... 166/380, 381, 166/382, 206, 207

(56) References Cited

U.S. PATENT DOCUMENTS

| | | | | |
|---|---|---|---|---|
| 761,518 | A | 5/1904 | Lykken | |
| 1,324,303 | A | 12/1919 | Carmichael | |
| 1,545,039 | A | 7/1925 | Deavers | |
| 1,561,418 | A | 11/1925 | Duda | |
| 1,569,729 | A | 1/1926 | Duda | |
| 1,597,212 | A | 8/1926 | Spengler | |
| 1,930,825 | A | 10/1933 | Raymond | |
| 1,981,525 | A | 11/1934 | Price | 166/4 |
| 2,214,226 | A | 9/1940 | English | 166/1 |
| 2,216,226 | A | 10/1940 | Bumpous | 36/44 |

(List continued on next page.)

FOREIGN PATENT DOCUMENTS

| | | | |
|---|---|---|---|
| EP | 0 961 007 | 12/1999 | E21B/33/10 |
| GB | 887150 | 1/1962 | |
| GB | 1 448 304 | 9/1976 | E21B/33/13 |
| GB | 2 216 926 | 10/1989 | E21B/7/20 |
| GB | 2 230 734 | 7/1998 | E21B/33/127 |

(List continued on next page.)

OTHER PUBLICATIONS

U.S. patent application Ser. No. 10/280,392, Lauritzen et al., filed Oct. 25, 2002.

(List continued on next page.)

*Primary Examiner*—David Bagnall
*Assistant Examiner*—K. Thompson
(74) *Attorney, Agent, or Firm*—Moser, Patterson & Sheridan, L.L.P.

(57) ABSTRACT

The present invention provides apparatus and methods for completing a wellbore using expandable tubulars. In one aspect, the invention includes a tubular member with an expandable portion at a lower end constructed and arranged to be expanded into contact with a previously expanded liner. At an upper end of the tubular is a polish bore receptacle permitting the tubular to be tied back to the surface of the well with production tubing. In another aspect, the invention provides a method of completing a well comprising expanding a liner top into a cased wellbore to hang the liner and, thereafter running a tubular member into the wellbore.

25 Claims, 5 Drawing Sheets

U.S. PATENT DOCUMENTS

| | | | | |
|---|---|---|---|---|
| 2,383,214 | A | 8/1945 | Prout | 153/82 |
| 2,499,630 | A | 3/1950 | Clark | 153/81 |
| 2,627,891 | A | 2/1953 | Clark | 153/82 |
| 2,663,073 | A | 12/1953 | Bieber et al. | 29/148 |
| 2,898,971 | A | 9/1959 | Hempel | 153/82 |
| 3,087,546 | A | 4/1963 | Wooley | 166/46 |
| 3,191,677 | A | 6/1965 | Kinley | 166/14 |
| 3,195,646 | A | 7/1965 | Brown | 166/208 |
| 3,467,180 | A | 9/1969 | Pensotti | 165/180 |
| 3,712,376 | A | 1/1973 | Owen et al. | 166/277 |
| 3,776,307 | A | 12/1973 | Young | 166/125 |
| 3,818,734 | A | 6/1974 | Bateman | 72/75 |
| 3,911,707 | A | 10/1975 | Minakov et al. | 72/76 |
| 3,948,321 | A | 4/1976 | Owen et al. | 166/277 |
| 4,069,573 | A | 1/1978 | Rogers, Jr. et al. | 29/421 R |
| 4,127,168 | A | 11/1978 | Hanson et al. | 166/123 |
| 4,159,564 | A | 7/1979 | Cooper, Jr. | 29/727 |
| 4,288,082 | A | 9/1981 | Setterberg, Jr. | 277/125 |
| 4,319,393 | A | 3/1982 | Pogonowski | 29/434 |
| 4,324,407 | A | 4/1982 | Upham et al. | 277/27 |
| 4,429,620 | A | 2/1984 | Burkhardt et al. | 91/395 |
| 4,531,581 | A | 7/1985 | Pringle et al. | 166/120 |
| 4,588,030 | A | 5/1986 | Blizzard | 166/120 |
| 4,697,640 | A | 10/1987 | Szarka | 166/120 |
| 4,848,469 | A | 7/1989 | Baugh et al. | 166/382 |
| 5,052,483 | A | 10/1991 | Hudson | 166/55 |
| 5,271,472 | A | 12/1993 | Leturno | 175/107 |
| 5,303,772 | A | 4/1994 | George et al. | 166/55.1 |
| 5,348,095 | A | 9/1994 | Worrall et al. | 166/380 |
| 5,409,059 | A | 4/1995 | McHardy | 166/208 |
| 5,435,400 | A | 7/1995 | Smith | 175/61 |
| 5,472,057 | A | 12/1995 | Winfree | 175/57 |
| 5,560,426 | A | 10/1996 | Trahan et al. | 166/120 |
| 5,685,369 | A | 11/1997 | Ellis et al. | 166/195 |
| 5,743,335 | A | 4/1998 | Bussear | 166/291 |
| 5,901,787 | A | 5/1999 | Boyle | 166/135 |
| 5,918,674 | A | 7/1999 | Head | 166/348 |
| 6,021,850 | A | 2/2000 | Wood et al. | 166/380 |
| 6,029,748 | A | 2/2000 | Forsyth et al. | 166/380 |
| 6,070,671 | A | 6/2000 | Cumming et al. | 166/381 |
| 6,098,717 | A | 8/2000 | Bailey et al. | 166/382 |
| 6,325,148 | B1 | 12/2001 | Trahan et al. | 166/297 |
| 6,425,444 | B1 | 7/2002 | Metcalfe et al. | 166/387 |
| 6,446,323 | B1 | 9/2002 | Metcalfe et al. | 29/523 |
| 6,446,724 | B2 * | 9/2002 | Baugh et al. | 166/285 |
| 6,550,539 | B2 * | 4/2003 | Maguire et al. | 166/380 |
| 2001/0040054 | A1 | 11/2001 | Haugen et al. | 175/61 |
| 2001/0045284 | A1 | 11/2001 | Simpson et al. | 166/313 |
| 2002/0145281 | A1 | 10/2002 | Matcalfe et al. | 285/206 |
| 2002/0166668 | A1 | 11/2002 | Metcalfe et al. | 166/378 |

FOREIGN PATENT DOCUMENTS

| | | | |
|---|---|---|---|
| GB | 2 329 918 | 4/1999 | E21B/43/10 |
| GB | 2 345 308 | 7/2000 | E21B/43/10 |
| GB | 2 346 632 | 8/2000 | E21B/43/10 |
| GB | 2 347 950 | 9/2000 | E21B/33/047 |
| GB | WO 01/60545 | 8/2001 | E21D/39/00 |
| WO | WO 93/24728 | 12/1993 | E21B/17/10 |
| WO | WO 99/18328 | 4/1999 | E21B/23/01 |
| WO | WO 99/23354 | 5/1999 | E21B/43/10 |
| WO | WO 00/37767 | 6/2000 | E21B/29/00 |
| WO | WO 00/37768 | 6/2000 | E21B/29/10 |
| WO | WO 00/37773 | 6/2000 | E21B/43/10 |

OTHER PUBLICATIONS

U.S. patent application Ser. No. 09/469,643, Matcalfe et al., filed Dec. 22, 1999.

U.S. patent application Ser. No. 09/949,986, Maguire et al., filed Sep. 10, 2001.

U.S. patent application Ser. No. 09/949,057, Coon, filed Sep. 7, 2001.

U.S. patent application Ser. No. 09/938,176, Coon, filed Aug. 23, 2001.

U.S. patent application Ser. No. 09/938,168, Coon, filed Aug. 23, 2001.

U.S. patent application Ser. No. 09/712,789, Simpson et al., filed Nov. 13, 2000.

* cited by examiner

TIE BACK AND METHOD FOR USE WITH EXPANDABLE TUBULARS

CROSS-REFERENCE TO RELATED APPLICATIONS

This application is a continuation of U.S. patent application Ser. No. 09/885,500, filed Jun. 20, 2001 now U.S. Pat. No. 6,550,539. The aforementioned related patent application is herein incorporated by reference.

BACKGROUND OF THE INVENTION

1. Field of the Invention

The present invention relates to wellbore completion. More particularly, the invention relates to a system of completing a wellbore through the expansion of tubulars. More particularly still, the invention relates to the expansion of one tubular into another to provide a sealable connection therebetween.

2. Description of the Related Art

Wellbores are typically formed by drilling and thereafter lining a borehole with steel pipe called casing. The casing provides support to the wellbore and facilitates the isolation of certain areas of the wellbore adjacent hydrocarbon bearing formations. The casing typically extends down the wellbore from the surface of the well and the annular area between the outside of the casing and the borehole in the earth is filled with cement to permanently set the casing in the wellbore.

As the wellbore is drilled to a new depth, additional strings of pipe are run into the well to that depth whereby the upper portion of the string of pipe, or liner, is overlapping the lower portion of the casing. The liner string is then fixed or hung in the wellbore, usually by some mechanical slip means well known in the art.

In some instances wells are completed with the remote perforating of liner to provide a fluid path for hydrocarbons to enter the wellbore where they flow into a screened portion of another smaller tubular or production tubing. In these instances, the wellbore around the tubing is isolated with packers to close the annular area and urge the hydrocarbons into the production tubing. In other completions, the last string of liner extending into the wellbore is itself pre-slotted or perforated to receive and carry hydrocarbons upwards in the wellbore. In these instances, production tubing is usually connected to the top of the liner to serve as a conduit to the surface of the well. In this manner, the liner is "tied back" to the surface of the well. In order to complete these types of wells, the production tubing is inserted in the top of a liner in a sealing relationship usually accomplished by the use of a polish bore receptacle in the liner top. A polish bore receptacle has a smooth cylindrical inner bore designed to receive and seal a tubular having a seal assembly on its lower end. The polish bore receptacle and seal assembly combination allows the production tubing to be "stung" into the liner in a sealing relationship and be selectively removed therefrom.

Emerging technology permits wellbore tubulars to be expanded in situ. In addition to simply enlarging a tubular, the technology permits the physical attachment of a smaller tubular to a larger tubular by increasing the outer diameter of a smaller tubular with radial force from within. The expansion can be accomplished by a mandrel or a cone-shaped member urged through the tubular to be expanded or by an expander tool run in on a tubular string.

FIGS. 1 and 2 are perspective views of an expander tool 123 and FIG. 3 is an exploded view thereof. The expander tool 125 has a body 102 which is hollow and generally tubular with connectors 104 and 106 for connection to other components (not shown) of a downhole assembly. The connectors 104 and 106 are of a reduced diameter (compared to the outside diameter of the longitudinally central body part 108 of the tool 125), and together with three longitudinal flutes 110 on the central body part 108, allow the passage of fluids between the outside of the tool 125 and the interior of a tubular therearound (not shown). The central body part 108 has three lands 112 defined between the three flutes 110, each land 112 being formed with a respective recess 114 to hold a respective roller 116. Each of the recesses 114 has parallel sides and extends radially from the radially perforated tubular core 115 of the tool 125 to the exterior of the respective land 112. Each of the mutually identical rollers 116 is near-cylindrical and slightly barreled. Each of the rollers 116 is mounted by means of a bearing 118 at each end of the respective roller for rotation about a respective rotational axis which is parallel to the longitudinal axis of the tool 125 and radially offset therefrom at 120-degree mutual circumferential separations around the central body 108. The bearings 118 are formed as integral end members of radially slidable pistons 119, one piston 119 being slidably sealed within each radially extended recess 114. The inner end of each piston 119 (FIG. 2) is exposed to the pressure of fluid within the hollow core of the tool 125 by way of the radial perforations in the tubular core 115.

By utilizing an expander tool like the one described, the upper end of a liner can be expanded into the surrounding casing. In this manner, the conventional slip assembly and its related setting tools are eliminated. In one example, the liner is run into the wellbore on a run-in string with the expander tool disposed in the liner and connected thereto by a temporary connection. As the assembly reaches a predetermined depth whereby the top of the liner is adjacent a lower section of the casing, the expander tool is actuated and then, through rotational and/or axial movement of the actuated expander tool within the liner, the liner wall is expanded past its elastic limits and into contact with the wall of the casing. Rotation of the expander tool is performed by rotating the run-in string or by utilizing a mud motor in the run-in string to transfer fluid power to rotational movement.

While the foregoing method successfully hangs a liner in a casing without the use of slips, there are problems arising with the use of this method where production tubing must be subsequently stung into the top of a liner. One such problem relates to the polish bore receptacle which is formed in the inner surface of the liner. When the liner is expanded into the inner wall of the casing, the liner, because of the compliant rollers of the expander tool, tends to assume the shape of the casing wall. Because the casing is not perfectly round, the expanded liner is typically not a uniform inner circumference. Further, the inside surface of the liner is necessarily roughened by the movement of the rollers of the expander tool during expansion. These factors make it impracticable to expand a liner and then utilize that expanded portion as a polish bore receptacle.

There is a need therefore for a liner that can be expanded into contact with casing and can then be used to sealingly engage production tubing. There is a further need for a method of utilizing a liner as an expandable setting member in casing and also as a receptacle for production tubing.

SUMMARY OF THE INVENTION

The present invention provides apparatus and methods for completing a wellbore using expandable tubulars. In one aspect, the invention includes a tubular member with an expandable portion at a first end constructed and arranged to be expanded into contact with a larger diameter tubular therearound. At a second end of the tubular is a polish bore receptacle permitting the tubular to be tied back to the surface of the well with production tubing. In another aspect, the invention provides a method of completing a well comprising expanding a liner top into a cased wellbore to hang the liner and, thereafter running a tubular member into the wellbore. The tubular member is expanded at a first end into contact with the liner. Thereafter, production tubing having a seal assembly thereupon is stung into a polish bore receptacle formed in a second end of the tubular.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
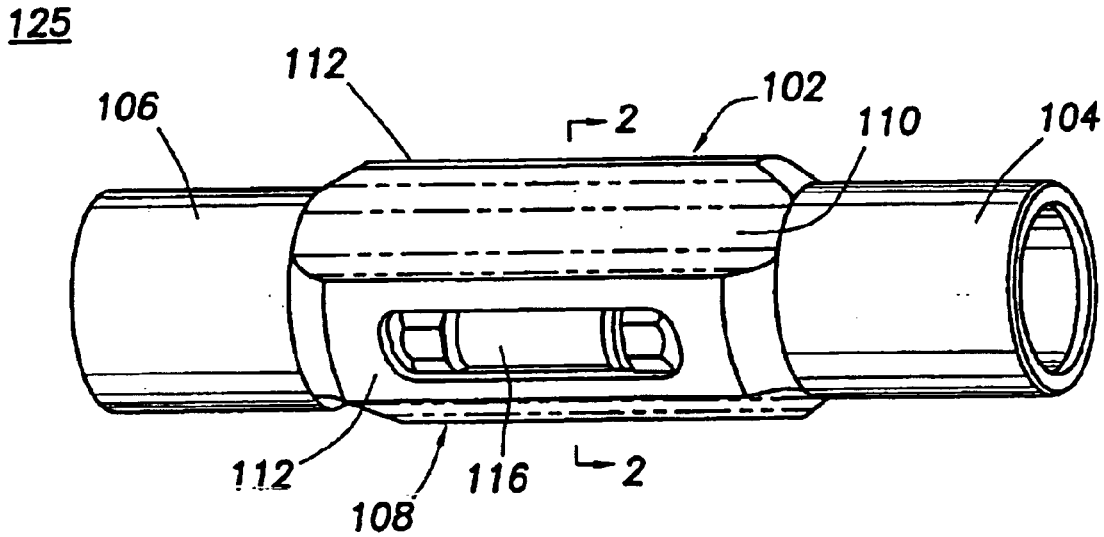
FIG. 1 is a perspective view of an expander tool.
Figure 2:
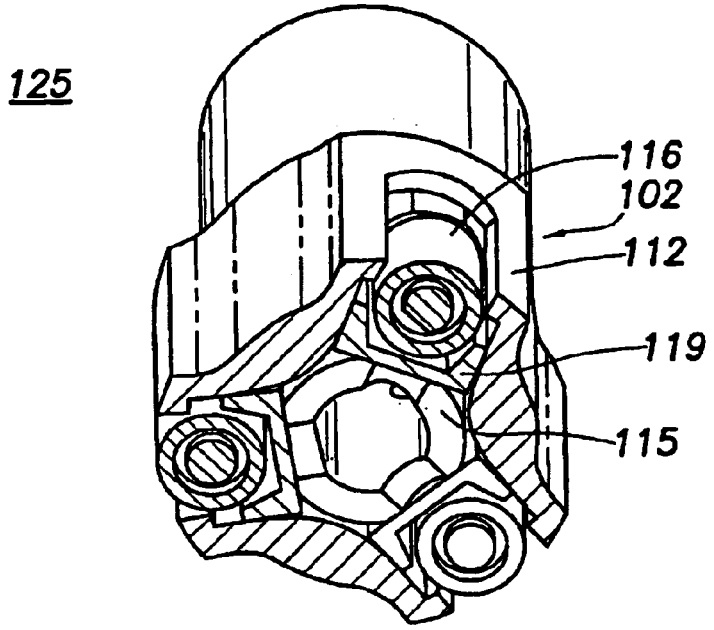
FIG. 2 is a perspective view of the expander tool.
Figure 3:
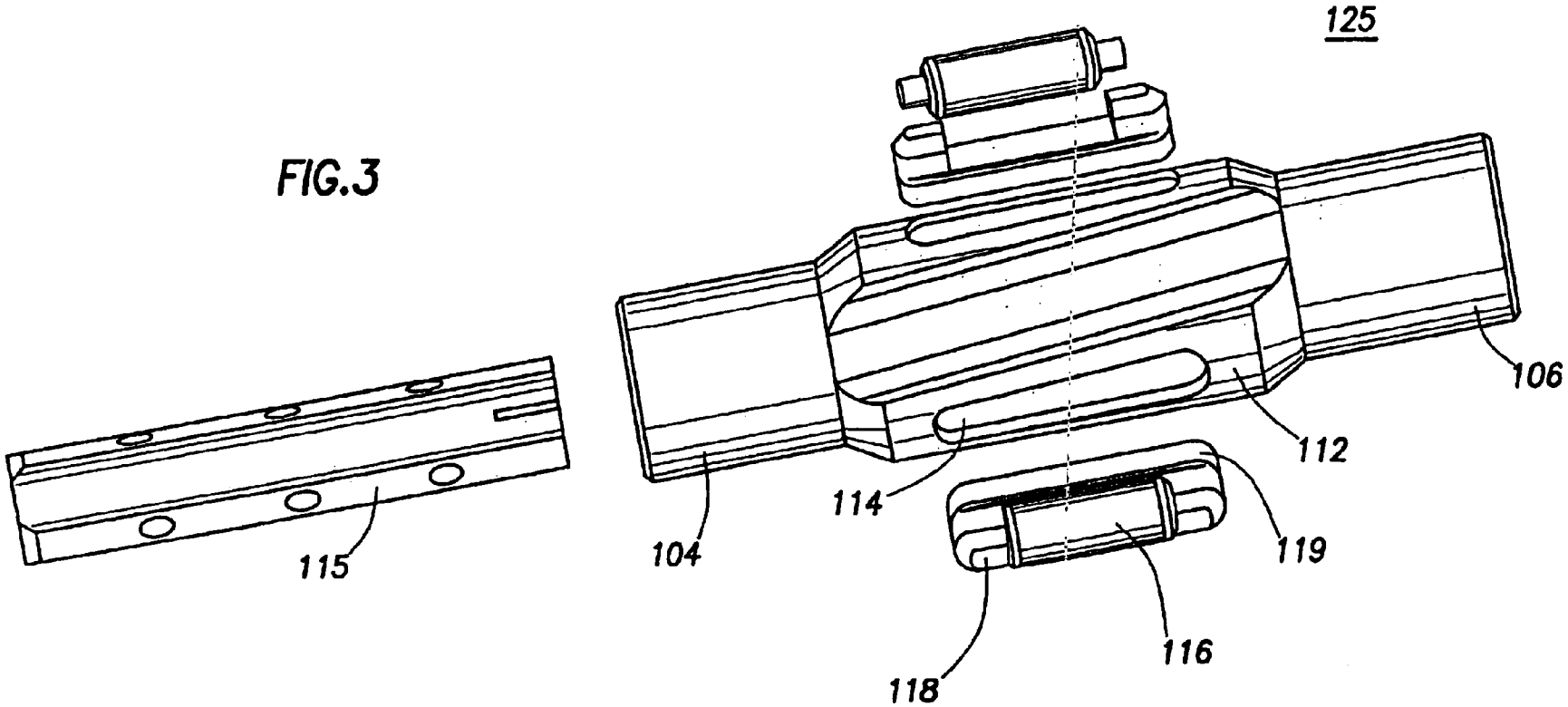
FIG. 3 is an exploded view of the expander tool.
Figure 4A:
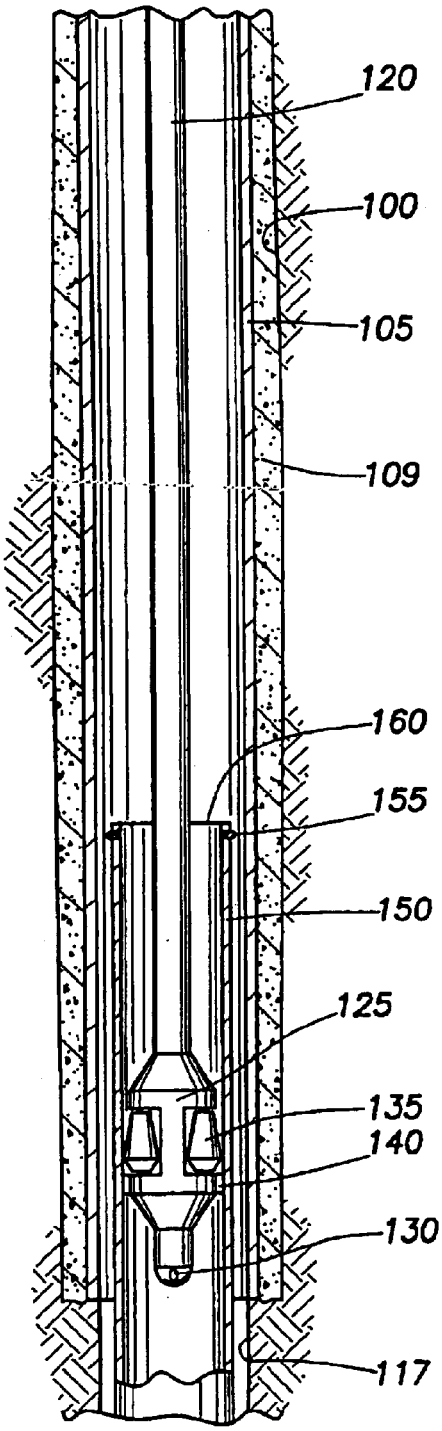
FIG. 4*a* is a section view of an expander tool disposed in a liner.

FIG. 4*a* is a section view of a wellbore 100 having casing 105 along the walls thereof and cement 109 filling an annular area between the casing 105 and the earth. FIG. 4*a* illustrates that section of the wellbore where the casing terminates leaving a new, unlined section of borehole 117 exposed. Also shown in the Figure is a run-in string of tubular 120 with an expander tool 125 of the type previously described disposed on an end thereof. The expander tool shown is designed for use at the end of a tubular and includes ports 130 at a lower end where fluid may be circulated through the tool. In the embodiment shown, the rollers 135 of the tool are conically shaped to facilitate expansion in an upwards direction as will be described herein. Attached to the expander tool 125 with a temporary connection 140 is liner 150 which is run into the well along with the expander tool. The temporary connection between the expander tool and the liner can be a shearable connection or may be some other mechanical or hydraulic arrangement wherein the connection can bear the weight of the liner but can later be remotely disconnected to permit the run in string and expander tool to move independent of the liner. In one alternative example, the connection is a collet with hydraulically actuated release means. The liner 150 has a smaller outside diameter than the wellbore casing 105 and is designed to line the newly formed wellbore. The liner includes a sealing member 155 disposed therearound for sealing between the expanded liner and the casing as described herein. The sealing member 155 may be constructed of ductile metal or polymer material and is typically heat and corrosion resistive.

Figure 4B:
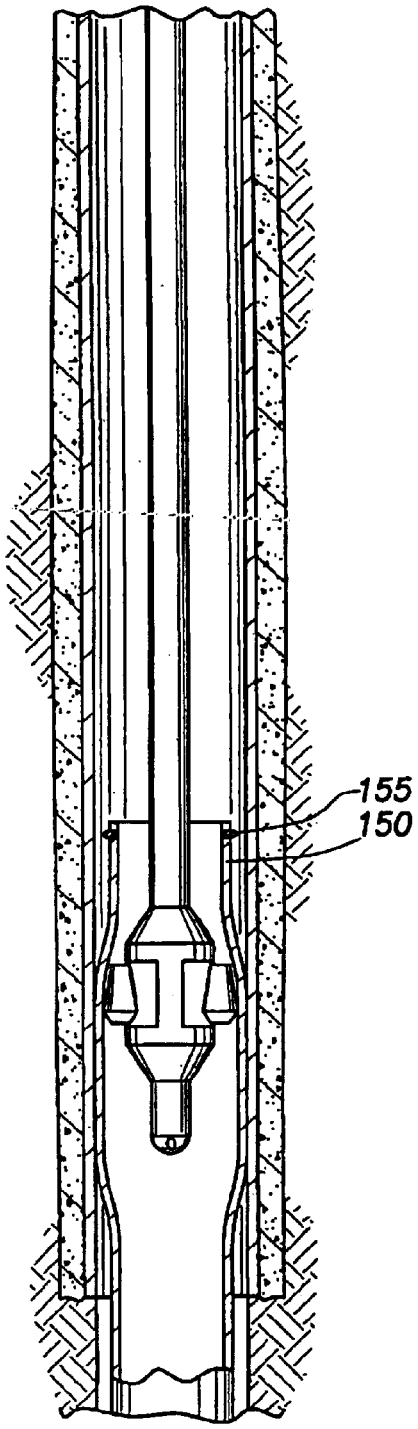
FIG. 4*b* is a section view of the liner being expanded by the expander tool into surrounding casing.
Figure 4C:
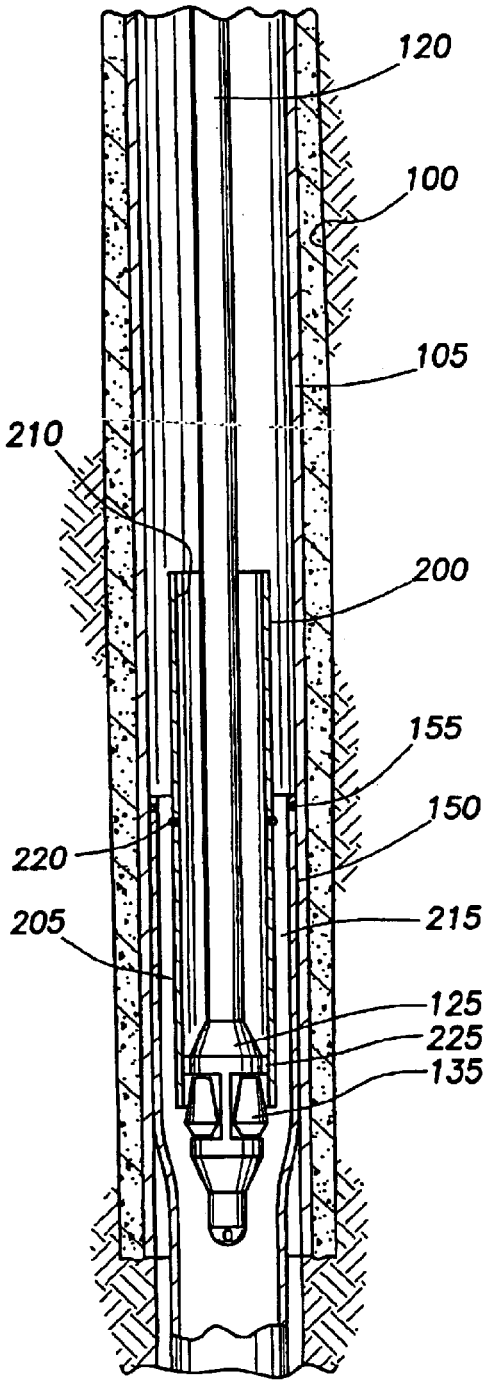
FIG. 4*c* is a section view of an expander tool disposed in a tubular member.

The liner 150 is set in the casing 105 by positioning the top portion 160 of the liner in an overlapping relationship with the lower portion of the casing, as illustrated. Thereafter, the expander tool 125 is actuated with fluid pressure delivered from the run-in string 120 and the rollers 135 of the expander tool will extend radially outward. With at least some portion of the wall of the liner 150 in contact with the casing, the run-in string 120 and expander tool 125 are rotated and/or urged upwards. In this manner, a shearable connection 140 between the expander tool 125 and the liner 150 can be caused to fail and the liner may be circumferentially expanded into contact with the casing as illustrated in FIG. 4*b*. Alternatively, some other mechanical connection means can be remotely disengaged after the expander tool has caused the liner to become frictionally attached to the casing. FIG. 4*c* illustrates the liner completely expanded into the casing including sealing member 155 which has sealed the annular area between the liner 150 and the casing 105.

After the liner 150 is completely expanded into the casing 105, the expander tool 125 is removed and subsequently, tubular member 200 is run into the wellbore 100 with the expander tool 125 disposed therein on run-in string 120. As illustrated in FIG. 4*c*, the tubular member 200 has an outside diameter that easily fits within the expanded portion of the liner 150. The tubular member 200 is a section of tubular having an expandable lower portion 205 and a non-expandable, polish bore receptacle 210 formed in an upper end thereof. The expandable lower portion 205 is expandable into the expanded upper portion of the liner 150. FIG. 4*c* illustrates the tubular member 200 positioned in the wellbore 100 prior to expansion into the liner. The lower expandable portion 205 of the member 200 is adjacent the upper portion of the expanded liner 150 with an annular area 215 therebetween. A sealing member 220 is disposed around the lower portion 205 of the member 200 to create a seal between the expanded lower portion 205 and the liner 150. The upper portion of the member 200 with the polish bore receptacle 210 extends above the top of the liner. Proper placement of the tubular member 200 in the liner 150 can be ensured using a profile (not shown) formed on the member with a mating groove formed in the interior of the liner 150. In the embodiment shown, the polish bore receptacle is formed in the upper position of the tubular member 200. However, it will be understood that the polish bore receptacle could be formed in the lower portion of the member and the upper portion could be expandable.

The expander tool 125 is connected to the tubular member with a temporary connection 225 like a shearable connection or some other remotely disengagable connection means, permitting the weight of the tubular member to be born by the run-in string prior to expansion of the member 200.

Figure 4D:
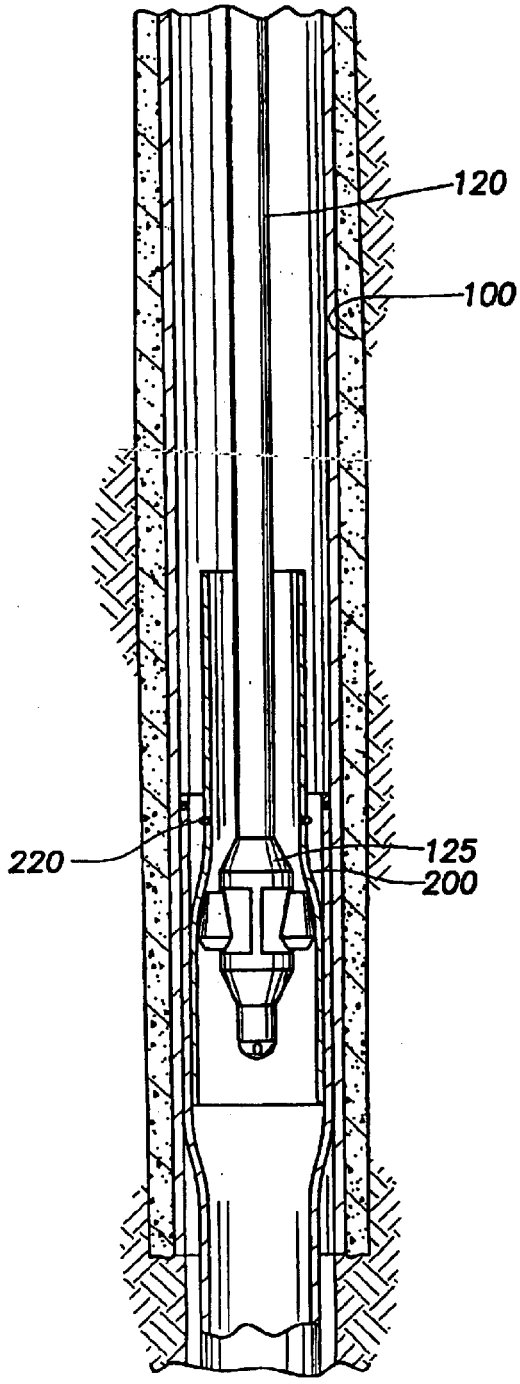
FIG. 4*d* is a section view showing the tubular member being expanded by the expander tool into the liner therearound.

In order to set the tubular member 200, the expander tool 125 is actuated with pressurized fluid as previously described. The expandable members or rollers 135 on the tool extend outward radially expanding the lower section 205 of the member into contact with the wall of the liner 150, whereby the weight of the tubular member is transferred to the liner. With axial and/or rotational movement of the actuated tool 150 within the member 200, a temporary connection between the expander tool and the member 200 can be released and the bottom portion of the tubular is circumferentially expanded as illustrated in FIG. 4*d*. After the expansion of the lower portion of the tubular, the expander tool 125 is deactuated and the rollers 135 retract, thereby permitting the tool 125 to pass through the unexpanded upper portion of the tubular member and be removed from the wellbore without damaging the polish bore receptacle 210.

Figure 4E:
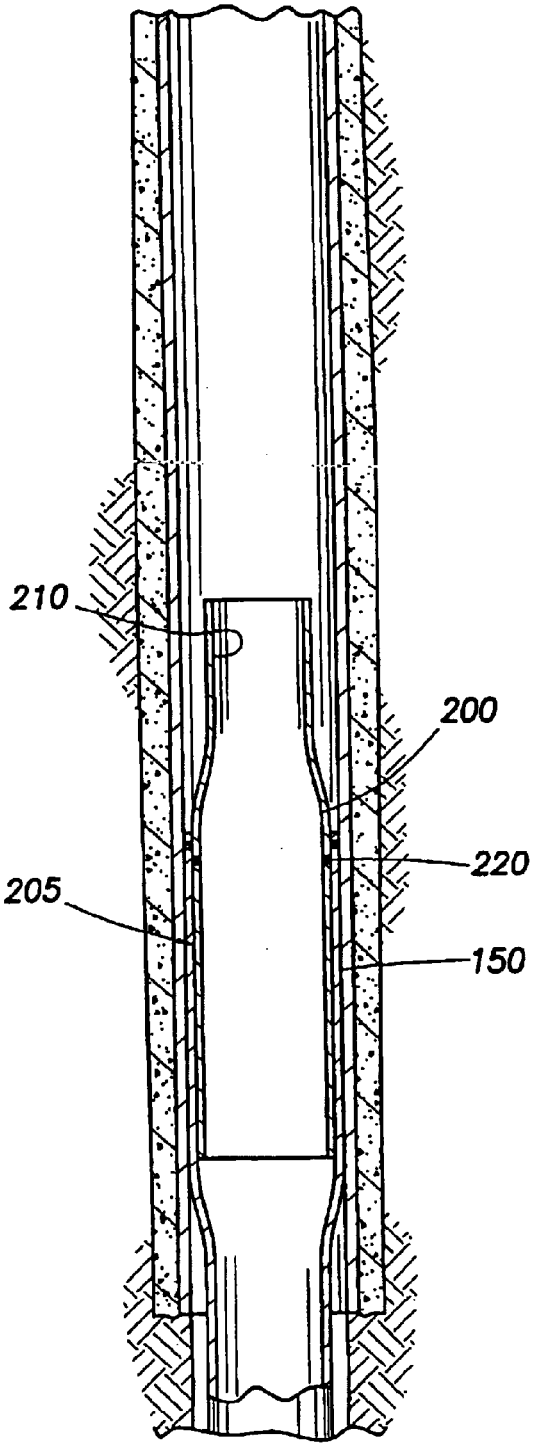
FIG. 4*e* is a section view showing the tubular member, the lower portion of which is expanded into contact with the liner.

FIG. 4*e* is a section view of the wellbore 100 illustrating the unexpanded top of member 200 and the expanded lower section 205 of the member 200. As shown, the sealing member 220 has sealed the area between the expanded member and the liner 150. The unexpanded upper portion of the member 200 retains its original inside interior polish bore receptacle 210 which can now be used to receive production tubing (FIG. 4*f*).

Figure 4F:
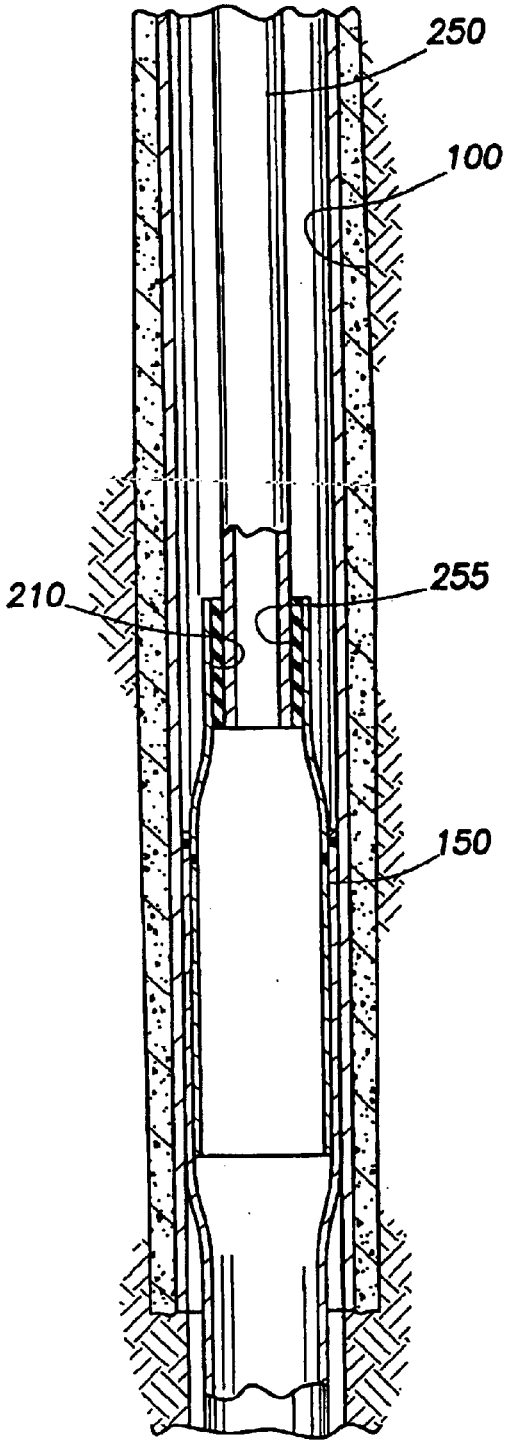
FIG. 4*f* is a section view showing production tubing string inserted into a polish bore receptacle formed in the upper portion of the tubular member.

FIG. 4*f* is a section view of the wellbore 100 illustrating production tubing 250 with a seal assembly 255 on the lower outer portion thereof inserted or "stung" into the polish bore receptacle 210 in the upper portion of the tubular member 200. In this manner, the liner 150 is tied back to the surface of the well and hydrocarbons may follow the fluid path formed in the liner 150 and in the production tubing 250.

The lower portion of the tubular member may be made of a more ductible material to facilitate expansion or its wall thickness may be thinner, resulting in a slightly enlarged inner diameter. Also, the upper and lower portion of the tubular need not be integrally formed but could be separate tubular pieces.

While the liner and tubular member are shown run into the wellbore on a run in string of tubulars, it will be understood that the apparatus of the invention can be transported into the wellbore using any number of means including coiled tubing and electrical wire. For example, using coiled tubing and a mud motor disposed thereupon, the apparatus can be utilized with rotation of the expander tool provided by the mud motor. Similarly, electrical line can be used to transport the apparatus and to carry its weight and also to provide a source of electrical power to a downhole electric motor. The motor can operate a downhole pump that provides a source of pressurized fluid to the expander tool. Additionally, the electric motor can provide power to a mud motor which in turn, provides rotational movement to the expander tool. These variations are within the scope of the invention.

As described, the invention provides apparatus and methods for completing a well using expandable components. Specifically, the invention solves the problem of maintaining a polish bore receptacle at the upper end of a tubular that is expanded in a well. The expanded portion of the tubular member provides an effective seal and anchor within the liner. Additionally, the tubular member, once expanded, reinforces the liner hanger section therearound to prevent collapse. While a tubular member of the invention has been described in relation to an expandable liner top, the tubular could be used in any instance wherein a polish bore receptacle is needed in an expandable tubular and the invention is not limited to a particular use.

While the foregoing is directed to embodiments of the present invention, other and further embodiments of the invention may be devised without departing from the basic scope thereof, and the scope thereof is determined by the claims that follow.

What is claimed is:

1. A method of completing a well, comprising:

placing a first tubular in a wellbore proximate a lower end of a cased portion of the wellbore, leaving an overlapping portion therebetween;

expanding the first tubular in the overlapped portion, wherein the first tubular is operatively fixed in the cased portion;

placing a second tubular in the wellbore proximate the first tubular, the second tubular having a polished bore portion and an expandable portion;

expanding the expandable portion of the second tubular, whereby the second tubular is operatively fixed in the first tubular; and forming a fluid path to the surface of the well.

2. The method of claim 1, wherein the fluid path is formed by placing a third tubular in substantial contact with the polished bore portion.

3. A method for completing a wellbore, the wellbore having a lined portion, comprising:

running a first tubular into the wellbore, the first tubular having an expandable portion;

suspending the first tubular at a desired location within the wellbore, wherein at least the expandable portion of the first tubular is in an overlapping relationship with the lined portion of the wellbore;

expanding the expandable portion of the first tubular, wherein the expanded portion of the first tubular is sealingly engaged to the lined portion of the wellbore;

running a second tubular into the wellbore, the second tubular having a polished bore receptacle and an expandable portion;

suspending the second tubular at a desired location within the first tubular, wherein at least the expandable portion of the second tubular is in an overlapping relationship with the expanded portion of the first tubular;

expanding the expandable portion of the second tubular, wherein the expanded portion of the second tubular is sealingly engaged to the expanded portion of the first tubular; and mating a lower portion of a third tubular into the polished bore receptacle of the second tubular, wherein the lower portion of the third tubular is configured to sealingly land into the polished bore receptacle of the second tubular.

4. The method of claim 3, wherein the polished bore receptacle is disposed above the expandable portion of the second tubular.

5. The method of claim 3, wherein an outer surface of the expandable portion of the first tubular comprises at least one sea; member for assisting in the sealing engagement between the first tubular and the lined portion of the wellbore.

6. The method of claim 3, wherein an outer surface of the expandable portion of the second tubular comprises at least one seal member for assisting in the sealing engagement between the second tubular and the first tubular.

7. The method of claim 3, wherein the third tubular is production tubing, thereby forming a fluid path to the surface of the wellbore.

8. The method of claim 4, wherein the expandable portion of the first tubular and of the second tubular are expanded with an expander device having at least one outwardly actuatable, member disposed thereon.

9. The method of claim 8, wherein the first tubular and the second tubular are each run into the wellbore with the expander device.

10. The method of claim 9, wherein the first and second tubular are each connected to the expander device by a releasable connection.

11. The method of claim 10, wherein subsequent to the expansion of the expandable portion of the second tubular into the first tubular, the expander device is deactivated, thereby allowing the expander device to freely pass through the polished bore receptacle of the second tubular and be removed from the wellbore without damaging the polished bore receptacle.

12. The method of claim 4, wherein the polished bore receptacle of the second tubular is disposed above the top end of the first tubular.

13. The method of claim 12, wherein the second tubular can be suspended and expanded into a desired location within the first tubular by using a profile that is formed on an outer surface of the second tubular and designed to mate with a groove formed on an inner surface of the first tubular.

14. The method of claim 3, wherein the second tubular has a substantially constant wall thickness throughout.

15. The method of claim 3, wherein the expandable portion of the second tubular has a thinner wall thickness than the polished bore receptacle of the second tubular.

16. The method of claim 3, wherein the second tubular has a two-part construction comprising:

a first pipe having a polished bore receptacle; and a second pipe, the second pipe being expandable.

17. The method of claim 16, wherein the second pipe is manufactured out of a more ductile material than the first pipe, thereby facilitating the expansion of the second pipe.

18. A tubular system for completing a wellbore, the wellbore having a lined portion, the tubular system comprising:

a first tubular, the first tubular having an expandable portion, wherein the expandable portion is sealingly expandable against the lined portion of the wellbore by a radial outward force applied on an inner wall thereof; and a second tubular, the second tubular comprising:

a polished bore receptacle, wherein the polished bore receptacle is configured to sealingly receive a third tubular; and an expandable portion, wherein the expandable portion is sealingly expandable against the expanded portion of the first tubular by a radial outward force applied on an inner wall thereof.

19. The tubular system of claim 18, wherein the polished bore receptacle is disposed above the expandable portion of the second tubular.

20. The tubular system of claim 18, wherein the third tubular is production tubing, thereby forming a fluid path to the surface of the wellbore.

21. The tubular system of claim 19, wherein the first tubular and the second tubular are each run into the wellbore with an expander device.

22. The tubular system of claim 20, wherein subsequent to the expansion of the expandable portion of the second tubular into the first tubular, the expander device is deactuated, thereby allowing the expander device to freely pass through the polished bore receptacle of the second tubular and be removed from the wellbore without damaging the polished bore receptacle.

23. The tubular system of claim 18, wherein the second tubular has a substantially constant wall thickness throughout.

24. The tubular system of claim 18, wherein the expandable portion of the second tubular has a thinner wall thickness than the polished bore receptacle of the second tubular.

25. The tubular system of claim 18, wherein the second tubular has a two-part construction comprising:

a first pipe having the polished bore receptacle; and a second pipe having the expandable portion.

* * * * *